United States Patent [19]

Hepworth et al.

[11] Patent Number: 4,615,820

[45] Date of Patent: Oct. 7, 1986

[54] DETERGENT COMPOSITIONS

[75] Inventors: Paul Hepworth, York; Roger I. Hancock, Cleveland, both of England

[73] Assignee: Imperial Chemical Industries PLC, London, England

[21] Appl. No.: 785,027

[22] Filed: Oct. 7, 1985

Related U.S. Application Data

[63] Continuation of Ser. No. 592,004, Mar. 21, 1984, abandoned.

[30] Foreign Application Priority Data

Mar. 28, 1983 [GB] United Kingdom ..... 8308508

[51] Int. Cl.[4] ..... C11D 7/52

[52] U.S. Cl. ..... 252/139; 252/104; 252/135; 252/140; 252/159; 252/160; 252/162; 252/163; 252/170; 252/174.22; 252/174.25; 252/DIG. 14

[58] Field of Search ..... 252/104, 135, 139, 140, 252/158, 159, 160, 162, 163, 170, 174.22, 174.25

[56] References Cited

U.S. PATENT DOCUMENTS 3,850,831 11/1974 Hellsten et al. ..... 252/104

FOREIGN PATENT DOCUMENTS 0030096 6/1981 European Pat. Off. .
1600981 10/1981 United Kingdom .

OTHER PUBLICATIONS

British Standards Institution BS 3900: Part A6: 1983, ISO 2431-1980 (Including Erratum 1-1981) Flow Time—"Part A6. Determination of Flow Time by Use of Flow Cups."

*Primary Examiner*—Paul Lieberman
*Assistant Examiner*—Hoa Van Le
*Attorney, Agent, or Firm*—Cushman, Darby & Cushman

[57] ABSTRACT

Liquid detergent compositions comprise 25-60% by weight of solids suspended in a liquid phase comprising at least 20% by weight of a condensation product of ethylene oxide with a mono- or di- or tri- hydroxy alkane having 1 to 4 carbon atoms having an average molecular weight in the range 150 to 600. The solids comprise a builder and optionally a bleach, and the liquid phase preferably comprises a surfactant.

10 Claims, No Drawings

DETERGENT COMPOSITIONS

This is a continuation of application Ser. No. 592,004, filed Mar. 21, 1984, which was abandoned upon the filing thereof.

This invention relates to detergent compositions.

In our co-pending European Patent Application No. 80304093.0, Publication No. 30096, ICI Case No. H 31072 we have described a liquid detergent composition which comprises a dispersion of solids comprising one or more builders and a bleach, the average particle diameter of the solids being at most 10 microns in a substantially water free non-ionic liquid surfactant which has a pour point of less than 10° C. The compositions showed remarkable stability in the absence of dispersants for the solids.

We have now devised liquid compositions of low pour point containing suspended solids in which there is no unacceptable separation of the solids and which possess a satisfactory performance in washing fabrics which comprise in the liquid phase a substantial amount of for example a polyethylene glycol.

This invention comprises liquid detergent compositions which comprise 25 to 60% by weight of the composition of solids suspended in a non-aqueous liquid phase, the solids comprising a builder which preferably constitutes at least 15% and may constitute 25 to 60% by weight of the composition, optionally a bleach which may be 1 to 20% and more preferably 2 to 15% by weight of the composition and optionally a filler; in which the liquid phase comprises at least 20% by weight and preferably 25 to 90% and more preferably 50 to 85% by weight of a condensation product of ethylene oxide with a mono- di- or tri-hydroxy alkane having 1 to 4 carbon atoms which is preferably polyethylene glycol and which has an average molecular weight in the range 150 to 600 and preferably 200 to 300 and preferably 5 to 50% by weight of one or more surfactants.

Whilst compositions according to the invention possess surprisingly good washing characteristics for some fabrics even in the absence of a surfactant it is in general found that the performance is improved by incorporating a surfactant in the compositions.

It is preferred that the solids suspended in the composition should have average particle diameters of less than 10 microns and preferably less than 5 microns.

It is preferred that the pour point should be below 5° C. and it is more preferably below 0° C. The pour point may be measured by ASTM Test method designation D97-66 re-approved in 1971.

Any builder which is known for use in detergent compositions may be used in compositions according to the present invention. Generally such builders are inorganic in nature but some organic products in particular sodium carboxymethylcellulose may be used. Suitable inorganic builders include phosphates. e.g. trisodium phosphate, tetrasodium pyrophosphate, sodium hexametaphosphate and, preferably, sodium tripolyphosphate, carbonates e.g. sodium carbonate, soidum bicarbonate and sodium sesquicarbonate, clays e.g. kaolin, montmorillonites and sodium bentonite, and miscellaneous salts e.g. sodium metasilicate and sodium citrate and sodium nitrilotriacetate or zeolites. The potassium analogues of the sodium compounds may also be used.

In order to provide an effective dispersion of the solids in the liquid phase it is desirable that at least 80% of the particles of the solid have particle sizes less than 10 microns in diameter.

The surfactant component according to the invention is preferably a non ionic surfactant for example an alkylene oxide derivative for example of an amide, alkyl phenol or an alcohol. The alkyl group in the alkyl phenol may be straight chain or branched chain and may contain from 6 to 20 carbon atoms, e.g. para-nonyl phenol or para-dodecylphenol. The alcohol may contain 6 to 20 carbon atoms, particularly 10 to 16 carbon atoms. The alcohol is preferably a primary or secondary alcohol having a linear or mono branched alkyl group.

In general an alkyl phenol or alcohol derivative may comprise 2 to 20 alkylene oxide units which are preferably ethylene oxide units although a minor number of propylene oxide or a lesser number of butylene oxide units may also be present. The amide is suitably a mono- or di-alkanol amide e.g. a mono- or di-ethanolamide preferably of a $C_6$ to $C_{30}$ more preferably $C_{10}$ to $C_{20}$ alkanoic acid, e.g. coconut acids, tallow acids or stearic acid or an ethoxylated derivative thereof. An alternative non-ionic surfactant for use in a composition according to the invention comprises a copolymer of ethylene oxide with propylene oxide and/or butylene oxide. The copolymer may comprise a block of propylene and/or butylene oxide units on to which is grafted the ethylene oxide. The block preferably comprises 20 to 40 propylene oxide units, especially about 30 such units and 20 to 30 especially about 26 ethylene oxide units.

A further surfactant of the anionic or cationic type may be included if desired. Such anionic or cationic surfactants may be of known type for example the anionic detergents may be soaps, alkylbenzene or olefine sulphonates, alcohol sulphates or alcohol alkoxylate sulphates; the cationic surfactants are suitably di-$C_{10-22}$ and preferably di-$C_{16-18}$ alkyl, di-lower alkyl ammonium salts or hydroxides for example chlorides or sulphates or for example fabric softeners of the $C_{10-16}$ alkyl, di lower alkyl (for example methyl), substituted ethyl ammonium salts. The substituent on the ethyl group may be an —OOCR group where R is a $C_{13-22}$ alkyl group, and the anion of the salt may be a $RSO_4^-$ group where R is lower alkyl for example methyl. The lower alkyl groups are suitably methyl groups.

Suitable bleaches which may be present are alkali metal, for example sodium or potassium, perborates or percarbonates.

In compositions according to the invention the dispersion of the solids in the non-ionic surfactant is remarkably stable especially if the particle size of the solids is at most 10 microns. If the solids separate at all then the resulting phase is usually loosely flocculated and is readily redispersible while if the relative amounts of the solids, polyethylene glycol and non-ionic surfactant in the composition are correctly chosen there is little phase separation as the liquid fills the space between the loosely packed solid particles. The composition may also contain additives conventionally found in detergent compositions e.g. optical brightners, ethylene diamine tetra acetic acid, dyes, perfumes, enzymes or bleach activators. If an inert filler is included it may suitably be sodium or potassium sulphate. Compositions according to the invention may suitably be made by a process which comprises milling ingredients together.

EXAMPLES

Compositions containing the components shown in Table 1 were prepared by the following procedure.

The liquid ingredients were blended together in a Silverson mixer and the solid ingredients were added in aliquots whilst stirring. When all of the solids had been introduced mixing was continued for at least a further 5 minutes to ensure freedom from lumps. The resulting slurry was then passed into a Dyno-mill bead-mill to produce a dispersion in which at least 85% of the particles were less than 10 microns in diameter. 99% of the particles were less than 200 microns. These percentages are by weight. The viscosity at 25° C. was in the range 100 to 1,200 millipascal seconds. Products were all acceptably stable to storage.

TABLE 1

| Components % w/w | COMPOSITION NUMBER 1 | 2 | 3 | 4 | 5 | 6 | 7 | 8 |
|---|---|---|---|---|---|---|---|---|
| SODIUM TRIPOLYPHOSPHATE | 29.05 | 34.05 | 34.05 | 39.05 | 39.05 | 33.70 | 34.05 | 39.05 |
| SODIUM SULPHATE-ANHYDROUS | — | — | — | — | — | 11.62 | 5.00 | — |
| SODIUM PERBORATE MONOHYDRATE | 6.74 | 6.74 | 6.74 | 6.74 | 6.74 | — | 6.74 | 6.74 |
| SODIUM SILICATE MONOHYDRATE | 2.00 | 2.00 | 2.00 | 2.00 | 2.00 | 2.00 | 2.00 | 2.00 |
| ETHYLENE DIAMINE TETRA ACETIC ACID-TETRA SODIUM SALT | 1.00 | 1.00 | 1.00 | 1.00 | 1.00 | 1.00 | 1.00 | 1.00 |
| SODIUM CARBOXYMETHYL CELLULOSE | 1.00 | 1.00 | 1.00 | 1.00 | 1.00 | 1.00 | 1.00 | 1.00 |
| OPTICAL BRIGHTNER | 0.21 | 0.21 | 0.21 | 0.21 | 0.21 | 0.21 | 0.21 | 0.21 |
| CONDENSATION PRODUCT OF $C_{13-15}$ ALCOHOL WITH 7 MOLES ALKYLENE OXIDE COMPRISING OF 8% PROPYLENE OXIDE 92% ETHYLENE OXIDE | 33.75 | 20.625 | 10.31 | 3.75 | 5.00 | 3.75 | 3.75 | — |
| CONDENSATION PRODUCT OF $C_{13-C15}$ ALCOHOL WITH 3 MOLES ETHYLENE OXIDE | 11.25 | 6.875 | 3.44 | 1.25 | 0.00 | 1.25 | 1.25 | — |
| POLYETHYLENE GLYCOL MOLECULAR WEIGHT 200 | 15.00 | 27.5 | 41.25 | 45.00 | 45.00 | 44.50 | 45.00 | 50.0 |
| ENZYME* | | | | | | 1.00 | | |

*Esparase Slurry 8, made by Novo Industri A/S

The compositions were tested for their dispensibility which is indicative of the ease of which they can be introduced into typical washing machines.

100 grams of each composition was charged to the pre-wash slot (A) of the soap dispenser of a Bendix automatic washing machine. An extra metal guard was fitted to prevent the composition flowing from the slot (A) into the machine prematurely.

The machine was then set to a pre-wash setting. As soon as all of the pre-wash water had flowed into the machine the dispenser was removed and allowed to drain for about 15 seconds to allow excess water to drain away. The dispenser was weighed and the amount of "caked" material remaining in it is recorded in Table 2.

The compositions were also tested to determine their pour points. When temperatures below 0° C. were encountered this was done by cooling the composition in a flask to a series of temperatures and recording the lowest temperature at which noticable flow occured on tilting the flask through 90° for 1 minute. In other cases the compositions were cooled on a thermometer and the temperature at which dripping from the thermometer occured is shown. The pour points are shown in Table 2.

TABLE 2

| Composition Number | Viscosity m Pa s (25° C.) | Pour Point °C. | Dispensibility % remaining |
|---|---|---|---|
| 1 | 270 | 8 | 15 |
| 2 | 295 | 9 | 9 |
| 3 | 245 | 5 | 2 |
| 4 | 275 | 0 | 2 |
| 5 | 350 | 5 | 2 |
| 6 | 265 | −5° C. | 1 |
| 7 | 296 | −5° C. | 1 |
| 8 | — | <−5° C. | — |

The compositions were then tested for washing efficiency by the following procedure. Standard samples of cloth as indicated in the table below were washed in a standard Tergotometer at 60° C. using water of 50 parts per million and 300 parts per million hardness expressed as calcium carbonate in which was dissolved 2.5 grams per liter of each composition in turn. In each case 3 soiled cloth samples and 1 clean cloth sample were washed together. The reflectance of the cloths was measured before washing and after washing for 10 minutes rinsing and drying. The average change in reflectance in arbitrary units was determined for the 3 soiled test cloths and the difference in reflectance of the white cloth was also measured in order to test whether soil had been deposited on it from the other cloths. Reflectance was measured in a standard reflectometer (Colorgard 40°/0° reflectometer made by Gardner Instruments). In the reflectometer the sample is illuminated at an angle of 45° and light reflected at an angle of 0° is detected according to the ASTM standard E97-77. The results are shown in Table 3.

TABLE 3

| | CLOTH | | | | | | | | | | | |
|---|---|---|---|---|---|---|---|---|---|---|---|---|
| | E.M.P.A 117* | | | | KREFELD COTTON** | | | | KREFELD P/C*** | | | |
| | HARDNESS 50 ppm | | HARDNESS 300 ppm | | HARDNESS 50 ppm | | HARDNESS 300 ppm | | HARDNESS 50 ppm | | HARDNESS 300 ppm | |
| Composition | AV ΔR | BLANK | AV ΔR | BLANK | AV ΔR | BLANK | AV ΔR | BLANK | AV ΔR | BLANK | AV ΔR | BLANK |
| 1 | | | | | 29.1 | −2.1 | 22.6 | 0.6 | 21.7 | 2.7 | 13.5 | −1.5 |
| 2 | | | | | 29.5 | 0.7 | 22.8 | 0.3 | 23.6 | 0.4 | 20.2 | −0.1 |
| 3 | | | | | 28.4 | 3.9 | 21.0 | 0.3 | 23.2 | −0.5 | 21.3 | −2.2 |

TABLE 3-continued

| | CLOTH | | | | | | | | | | | |
|---|---|---|---|---|---|---|---|---|---|---|---|---|
| | E.M.P.A 117* | | | | KREFELD COTTON** | | | | KREFELD P/C*** | | | |
| | HARDNESS 50 ppm | | HARDNESS 300 ppm | | HARDNESS 50 ppm | | HARDNESS 300 ppm | | HARDNESS 50 ppm | | HARDNESS 300 ppm | |
| Composition | AV ΔR | BLANK | AV ΔR | BLANK | AV ΔR | BLANK | AV ΔR | BLANK | AV ΔR | BLANK | AV ΔR | BLANK |
| 4 | | | | | 28.6 | 1.1 | 21.2 | −0.6 | 23.4 | 3.5 | 12.4 | 2.6 |
| 5 | | | | | 27.0 | −0.4 | 19.5 | 0.9 | 22.3 | 0.1 | 20.1 | 2.2 |
| 6 | 46.0 | 4.2 | 42.0 | −0.5 | 26.6 | 2.7 | 16.2 | 0.5 | 23.4 | 0.5 | 19.1 | 1.7 |
| 7 | 5.8 | −0.7 | 3.6 | 0.9 | 25.8 | 1.9 | 18.9 | 2.5 | 21.6 | −1.3 | 19.4 | −0.2 |
| 8 | | | | | 23.5 | 0.5 | 6.5 | 2.4 | 5.8 | −1.3 | 3.0 | −1.6 |

AV ΔR means the average reflectance change of three samples.
BLANK refers to the change in reflectance of the clean cloth.
*Blended polyester/cotton fabric stained with blood, milk and china ink supplied by Eidgenussische Materialprufungs-Und Versuchanstalt.
**Blended polyester/cotton fabric (65% polyester/35% cotton) soiled with a proprietary soil, supplied by Washchereiforschung Krefeld Testgewebe GmbH.
***Cotton cloth soiled with proprietary soil supplied by Washchereiforschung Krefeld Testgewebe GmbH.

We claim:

1. A liquid detergent composition having a pour point of at most about 9° C. and a viscosity at 25° C. in the range of 100 to 1,200 millipascal seconds, which composition comprises 25 to 60% by weight of the composition of solids having average particle diameters of less than 10 microns, suspended in a non-aqueous liquid phase, the solids comprising a builder, in which the liquid phase comprises at least 20% by weight of a condensation product of ethylene oxide with a mono- or di- or tri-hydroxy alkane having 1 to 4 carbon atoms which condensation product has a molecular weight in the range 150 to 600.

2. A liquid detergent composition having a pour point of at most about 9° C. and a viscosity at 25° C. in the range of 100 to 1,200 millipascal seconds, which composition comprises 25 to 60% by weight of the composition of solids having average particle diameters of less than 10 microns, suspended in a non-aqueous liquid phase the solids comprising a builder, in which the liquid phase comprises at least 20% by weight of a polyethylene glycol having a molecular weight in the range of 150 to 600.

3. A composition according to claim 2 in which the liquid phase comprises 50 to 85% by weight of the polyethylene glycol and 5 to 50% by weight of one or more surfactants.

4. A composition as claimed in claim 3 in which the surfactant is a non-ionic surfactant which is an alkylene oxide derivative of an amide, alkyl phenol or alcohol.

5. A composition according to claim 2 in which the solids comprise 1 to 20% by weight of the composition of a bleach and 24 to 59% of the composition of a builder.

6. A composition as claimed in claim 3 in which at least 80% of the solids particles have diameters of less than 10 microns.

7. A composition as claimed in claim 3 in which the builder is a phosphate, carbonate, clay, zeolite, or sodium or potassium metasilicate, citrate or nitrilotriacetate.

8. A composition as claimed in claim 3 in which sodium or potassium perborate or percarbonate is present as a bleach.

9. A composition as claimed in claim 4 in which an anionic or cationic surfactant is present.

10. A composition as claimed in claim 3 which comprises an inert filler.

* * * * *